US007459805B2

(12) United States Patent
Kowari et al.

(10) Patent No.: US 7,459,805 B2
(45) Date of Patent: Dec. 2, 2008

(54) IMAGE FORMING APPARATUS

(75) Inventors: Tsuyoshi Kowari, Suwa (JP); Akihiko Koyama, Suwa (JP); Yasushige Hori, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 11/335,876

(22) Filed: Jan. 19, 2006

(65) Prior Publication Data

US 2006/0177236 A1 Aug. 10, 2006

(30) Foreign Application Priority Data

Jan. 19, 2005 (JP) ..... 2005-011856
Jan. 19, 2005 (JP) ..... 2005-011863
Jan. 19, 2005 (JP) ..... 2005-011867
Mar. 28, 2005 (JP) ..... 2005-092447

(51) Int. Cl.
*H01H 35/00* (2006.01)

(52) U.S. Cl. ..... 307/130

(58) Field of Classification Search ..... 307/130
See application file for complete search history.

(56) References Cited

U.S. PATENT DOCUMENTS

2007/0258178 A1* 11/2007 Hallak et al. ..... 361/93.7

FOREIGN PATENT DOCUMENTS

JP 2003-054097 2/2003

* cited by examiner

*Primary Examiner*—Robert L. DeBeradinis
(74) *Attorney, Agent, or Firm*—Hogan & Hartson LLP

(57) ABSTRACT

An image forming apparatus for forming an image with an electrophotographic process, that includes: a power source; a first drive unit having a capacitative load and driving each part of the apparatus; a second drive unit having a capacitative load and driving each part of the apparatus; and a power supply control circuit that is provided on a power supply path between the power source and the second drive unit, that switches whether or not electric power is supplied to the second drive unit. The power supply control circuit includes: a field-effect transistor with its source connected to the power source side of the power supply path, and its drain connected to the second drive unit side of the power supply path; a first resistive element connected between the field-effect transistor's gate and its source; a second resistive element and a capacitative element that are connected in parallel with the first resistive element, and connected with each other in series between the gate and the source.

18 Claims, 12 Drawing Sheets

IMAGE FORMING APPARATUS

CROSS-REFERENCES TO RELATED APPLICATIONS

This application relates to and claims priority from Japanese Patent Applications 2005-011856, 2005-011863, and 2005-011867, filed on Jan. 19, 2005, and Japanese Patent Application No. 2005-092447, filed on Mar. 28, 2005, the entire disclosure of which is incorporated herein by reference.

BACKGROUND

1. Technical Field

The present invention relates to an image forming apparatus such as a printer, a copying machine, or a facsimile.

2. Related Art

A related art example of an image forming apparatus with an electrophotographic process, such as a printer, copying machine, or facsimile, is disclosed in JP-A-2003-54097. This type of image forming apparatus generally uses two or more kinds of power supply voltages as power sources for driving an internal circuit. For example, components containing a microprocessor or the like, such as a controller for controlling the entire operation of the image forming apparatus, and a logic circuit that executes image signal processing and other functions, need a low-voltage (for example, 5 V) power source, while mechanisms such as a motor for driving a photosensitive drum and a paper-feed mechanism, and a laser unit as a light source for light exposure, that require high electric power need a high-voltage (for example, 24 V) power source.

In a general image forming apparatus, a switch that opens or closes a circuit in conjunction with the opening or closing action of a cover for covering the internal content of the main body is provided on the circuit in order to cut off power supply to a motor and other components when the cover is opened in the case where a malfunction (such as paper jamming) has occurred. However, when the switch opens the circuit, cutting off the power, and then closes the circuit again, a high inrush current sometimes flows into a condenser (capacitative load) mounted on a motor control substrate or similar, which is the power supply destination. The upper limit is set for a current value at which current can be passed through the switch, and the inrush current sometimes exceeds that upper limit. With that kind of malfunction problem, a step to avoid a high inrush current flowing into the switch is taken by providing, in addition to the above-mentioned switch, electronic switches such as field-effect transistors (FET) on a power supply path in order to divide the power supply destination, and turning on the respective transistors sequentially at certain time intervals. Moreover, after the cover has been opened and then closed in order to, for example, mount an optional device, in other words, after the switch and the FETS have been opened to cut off power, and then closed again, and if a short-circuit occurs due to, for example, inappropriate mounting of the optional device, an abnormal current may still flow into the optional device.

However, the image forming apparatus disclosed in JP-A-2003-54097 has the problem of incapability to appropriately control a power supply voltage in a component connected to the FETs if an abnormal current is generated in the power supply path due to a short circuit or similar.

SUMMARY

According to an aspect of the invention, provided is an image forming apparatus for forming an image with an electrophotographic process, that includes: a power source; a first drive unit having a capacitative load and driving each part of the apparatus; a second drive unit having a capacitative load and driving each part of the apparatus; and a power supply control circuit that is provided on a power supply path between the power source and the second drive unit, that switches whether or not electric power is supplied to the second drive unit. The power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

According to another aspect of the invention, provided is an image forming apparatus for forming an image with an electrophotographic process, including: a drive unit having a capacitative load and driving each part of the apparatus; a power source for supplying electric power to the drive unit; a switch that is located on a power supply path extending from the power source toward the drive unit, that switches whether or not electric power is supplied to the drive unit, by bringing the drive unit into conduction or non-conduction depending on the action of a specified part of the image forming apparatus; and a power supply control circuit that is provided on the power supply path between the switch and the drive unit, that supplies electric power to the drive unit by becoming conductive in conjunction with the conductive state of the switch. The power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

According to a further aspect of the invention, provided is an image forming apparatus including: an engine unit for forming an image; a drive power source for generating a drive voltage to be supplied to the engine unit; an FET that is provided between the engine unit and the drive power source, that switches whether or not the drive voltage is supplied to the engine unit; a detector for detecting fluctuation in the drive voltage; and an FET controller for controlling whether the FET is turned on or off depending on fluctuation of the drive voltage detected by the detector.

According to a still further aspect of the invention, provided is an image forming apparatus including: an engine unit for forming an image; a drive power source for generating a drive voltage to be supplied to the engine unit; an FET that is provided between the engine unit and the drive power source, that switches whether or not the drive voltage is supplied to the engine unit; an FET controller for controlling whether the FET is turned on or off depending on fluctuation of the drive voltage; and a flag controller for generating a flag when the FET controller turns the FET on; wherein if the drive voltage fluctuates when the flag controller has generated a flag and the FET controller has turned the FET on, the FET controller turns the FET off in the state where the flag has been generated.

DESCRIPTION OF EXEMPLARY EMBODIMENTS

Figure 1:
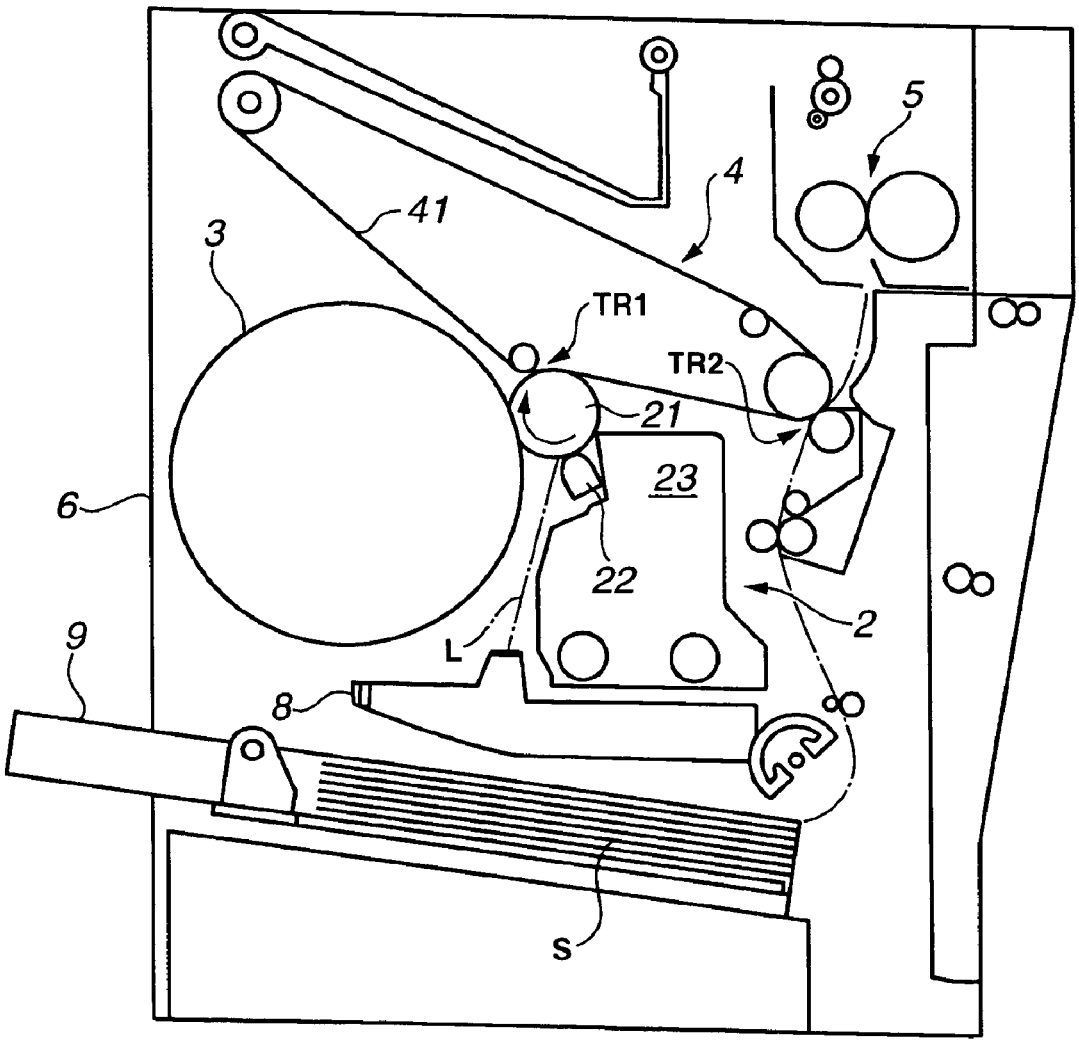
FIG. 1 is an explanatory diagram of the overall configuration of an image forming apparatus according to the first embodiment of the invention.

According to an aspect of the invention, provided is an image forming apparatus for forming an image with an electrophotographic process, that includes: a power source; a first drive unit having a capacitative load and driving each part of the apparatus; a second drive unit having a capacitative load and driving each part of the apparatus; and a power supply control circuit that is provided on a power supply path between the power source and the second drive unit, that switches whether or not electric power is supplied to the second drive unit. The power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

In the above-described configuration, because of the series circuit composed of the second resistive element and the capacitative element, no potential difference is generated between the gate and source of the field-effect transistor, and electric current does not pass through the transistor immediately after the switch has been turned on. Accordingly, it is possible to avoid any unexpected power supply to the second drive unit, and generation of an excessive inrush current can be prevented by setting a power supply time difference between the first drive unit and the second drive unit.

The image forming apparatus may be configured in such a manner that it further includes a switch that is located on power supply paths extending from the power source toward the first drive unit and the second drive unit respectively, at a position closer to the power source than the power supply control circuit, that switches whether or not electric power is supplied to the first or second drive unit, by bringing the first or second drive unit into conduction or non-conduction depending on the action of a specified part of the image forming apparatus.

Accordingly, it is possible to prevent a high inrush current from flowing into the switch.

Moreover, the switch may bring the first or second drive unit into conduction or non-conduction depending on the opening or closing action of a cover for protecting the outside surface of the image forming apparatus.

Therefore, generation of an inrush current by opening and closing the cover can be avoided.

According to another aspect of the invention, provided is an image forming apparatus for forming an image with an electrophotographic process, including: a drive unit having a capacitative load and driving each part of the apparatus; a power source for supplying electric power to the drive unit; a switch that is located on a power supply path extending from the power source toward the drive unit, that switches whether or not electric power is supplied to the drive unit, by bringing the drive unit into conduction or non-conduction depending on the action of a specified part of the image forming apparatus; and a power supply control circuit that is provided on the power supply path between the switch and the drive unit, that supplies electric power to the drive unit by becoming conductive in conjunction with the conductive state of the switch. The power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

In the above-described configuration, because of the series circuit composed of the second resistive element and the capacitative element, no potential difference is generated between the gate and source of the field-effect transistor, and electric current does not pass through the transistor immediately after the switch has been turned on. Accordingly, it is possible to inhibit an inrush current. Also, gradual switching of the field-effect transistor is realized, thereby enabling reduction in inrush current when the field-effect transistor has been turned on.

The switch may bring the drive unit into conduction or non-conduction depending on the opening or closing action of a cover for protecting the outside surface of the image forming apparatus.

Therefore, generation of an inrush current by opening and closing the cover can be avoided.

According to a further aspect of the invention, provided is an image forming apparatus including: an engine unit for forming an image; a drive power source for generating a drive voltage to be supplied to the engine unit; an FET that is provided between the engine unit and the drive power source, that switches whether or not the drive voltage is supplied to the engine unit; a detector for detecting fluctuation in the drive voltage; and an FET controller for controlling whether the FET is turned on or off depending on fluctuation of the drive voltage detected by the detector.

In the above-described configuration, whether or not the drive voltage is supplied to the engine unit is controlled by fluctuation in the drive voltage. Accordingly, even if an abnormal current is generated due to a short circuit or leakage at the engine unit, the drive voltage supply to the engine unit can be controlled appropriately without cutting off the drive power supply.

The image forming apparatus may include a plurality of FETs, and the FET controller may turn the FETs off sequentially when the detector detects fluctuation in the drive voltage.

The above-described configuration is designed in such a way that if an error occurs in a component connected to any of the FETs, the drive voltage will return to its original state when the relevant FET is turned off. Therefore, with the above-described configuration, it is possible to determine the location where the error has occurred, and notify the user of the error details.

The image forming apparatus may include a plurality of FETs, and the FET controller may turn the FETs off sequentially if the detector detects fluctuation of the drive voltage, and the FET controller then sequentially turns on the FETs that have been turned off.

The above-described configuration is designed in such a way that if an error occurs in a component connected to any of the FETs, the drive voltage will decrease when the relevant FET is turned on. Therefore, with the above-described configuration, it is possible to determine the location where the error has occurred, and notify the user of the error details.

In the image forming apparatus, the FET controller may turn the FET off when the drive voltage becomes lower than a specified value; and if the drive voltage becomes higher than the specified value when the FET has been turned off, the FET controller may judge that there is an error in the configuration of the engine unit connected to the FET.

In the above-described configuration, fluctuation of the drive voltage can be ascertained by controlling whether the FET is turned on or off. Therefore, it is possible to check whether or not any error has occurred in the configuration in which the FET supplies the drive voltage, and to notify the user of the error details.

Concerning the FET in the image forming apparatus, its source may be connected to the drive power source, its drain may be connected to the engine unit, and its gate may be connected to the FET controller, and the FET controller may include: a first resistive element provided between the source and the gate; and a second resistive element and a capacitative element connected in parallel with the first resistive element and located between the source and the gate.

In the above-described configuration, because of the series circuit composed of the second resistive element and the capacitative element, no potential difference is generated between the gate and source of the field-effect transistor, and electric current does not pass through the transistor immediately after the FET has been turned on. Accordingly, it is possible to inhibit an inrush current. Moreover, gradual switching of the FET can be realized, and any inrush current can be reduced when the FET has been turned on. Also, although a sudden increase in the inrush current is inhibited by the series circuit of the second resistive element and the capacitative element, it is possible in the above-described configuration to turn the FET off as appropriate and control the drive voltage supply to the engine unit.

According to a still further aspect of the invention, provided is an image forming apparatus including: an engine unit for forming an image; a drive power source for generating a drive voltage to be supplied to the engine unit; an FET that is provided between the engine unit and the drive power source, that switches whether or not the drive voltage is supplied to the engine unit; an FET controller for controlling whether the FET is turned on or off depending on fluctuation of the drive voltage; and a flag controller for generating a flag when the FET controller turns the FET on; wherein if the drive voltage fluctuates when the flag controller has generated a flag and the FET controller has turned the FET on, the FET controller turns the FET off in the state where the flag has been generated.

The above-described configuration is designed in such a way that when the FET has been turned on and the drive voltage has been supplied to the engine unit, and if an abnormal current is generated due to, for example, bad connection of the optional device and the drive voltage fluctuates, the FET controller turns the FET off in the state where the flag is on. Therefore, where the FET has been turned off due to generation of an abnormal current and, for example, the image forming apparatus is to be reset, it is possible in the above-described configuration to confirm the possibility of occurrence of an error when turning on the FET again, by checking the flag state. Incidentally, the expression "when X turns the FET on" (or any similar expression) includes the state where an attempt is being made to turn the FET on, the moment the FET is turned on, and immediately before turning on the FET, while the expression "when X has turned the FET on" (or any similar expression) includes the moment the FET is turned on and immediately after the FET has been turned on.

If in the image forming apparatus the drive voltage does not fluctuate when the FET controller has turned the FET on, the flag controller may clear the flag.

The above-described configuration is designed in such a way that the flag is turned off if there is no error. Accordingly, if there is an error, the FET is turned off in the state where the flag is on. If there is no error, the flag is cleared. Therefore, in the above-described configuration, even in the case where an abnormal current is generated every time the FET is turned on due to, for example, bad connection of the optional device, it is possible to prevent the generation of an abnormal current by not turning the FET on.

If in the image forming apparatus the drive voltage is higher than a specified value for a specified period of time after the FET controller has turned the FET on, it is preferable that the flag controller clear the flag. Moreover, if in the image forming apparatus the drive voltage becomes lower than a specified value when the FET controller has turned the FET on, the FET controller may turn the FET off in the state where the flag has been generated.

The image forming apparatus may further include a notifying unit for giving a specified notice to a user if the flag has been generated when the FET controller turns the FET on.

If an abnormal current is generated due to, for example, bad connection of the optional device in the above-described configuration, it is possible to notify the user of the occurrence of an error.

Embodiments of the invention will be described below with reference to the relevant drawings. However, the following embodiments do not limit the invention described in the scope of claims, and all combinations of the characteristics described in the embodiments are not necessarily indispensable for solving the problems to be overcome by the invention.

First Embodiment

FIG. 1 is an explanatory diagram of the overall configuration of an image forming apparatus according to the first embodiment of the invention. The image forming apparatus shown in FIG. 1 forms full-color images by applying toners of four colors—yellow (Y), magenta (M), cyan (C), and black (K)—one over another, and also forms black-and-white images by using only back toner. This image forming apparatus is configured in such a way that when a picture signal is sent from an external apparatus (not shown in the drawing) such as a host computer, each component operates under the control of a main controller and an engine controller, and forms (i.e., prints) images corresponding to the picture signal on sheets S such as copying paper, transfer paper, paper, and OHP transparent sheets.

In the image forming apparatus shown in FIG. 1, a photoreceptor unit 2, a development unit 3, an intermediate transfer unit 4, and a fixing unit 5 are respectively configured in such a way that they can be attached to and detached from a main body (housing 6) of the apparatus. A photoreceptor 21 in a photoreceptor unit 2 rotates in the direction indicated with an arrow in FIG. 1 in the state where the respective units listed above are mounted on the main body 6. A charging member 22, the rotary development unit 3, and a cleaner 23 are respectively located around the photoreceptor 21 along its rotating direction. The rotary development member 3 contains four development units corresponding to the four colors Y, M, C, and K. The charging member 22, to which a charge bias is applied, uniformly charges the outside surface of the photoreceptor 21. The cleaner 23 cleans the photoreceptor 21 by scraping off the remaining toner attached to the outside surface of the photoreceptor 21 after primary transfer.

A light exposure unit 8 emits laser beam L according to the picture signal sent from the engine controller and has the outside surface of the photoreceptor 21 exposed to the laser beam L, forming an electrostatic latent image on the photoreceptor 21 corresponding to the picture signal. The electrostatic latent image formed as described above undergoes toner development via the rotary development unit 3. As a result, the electrostatic latent image on the photoreceptor 21 is made visible with toners of the four colors Y, M, C, and K. The thus developed toner image undergoes primary transfer by which the toner image is transferred onto an intermediate transfer belt 41 of the intermediate transfer unit 4 in a primary transfer area TR1. The image formed on the intermediate transfer belt 41 then undergoes secondary transfer in a specified secondary transfer area TR2 by which the image is transferred onto a sheet S taken from a cassette 9. The sheet S on which the image is formed in the above-described manner then passes through the fixing unit 5 and is carried to a catch tray located on the top surface of the main body 6.

Figure 2:
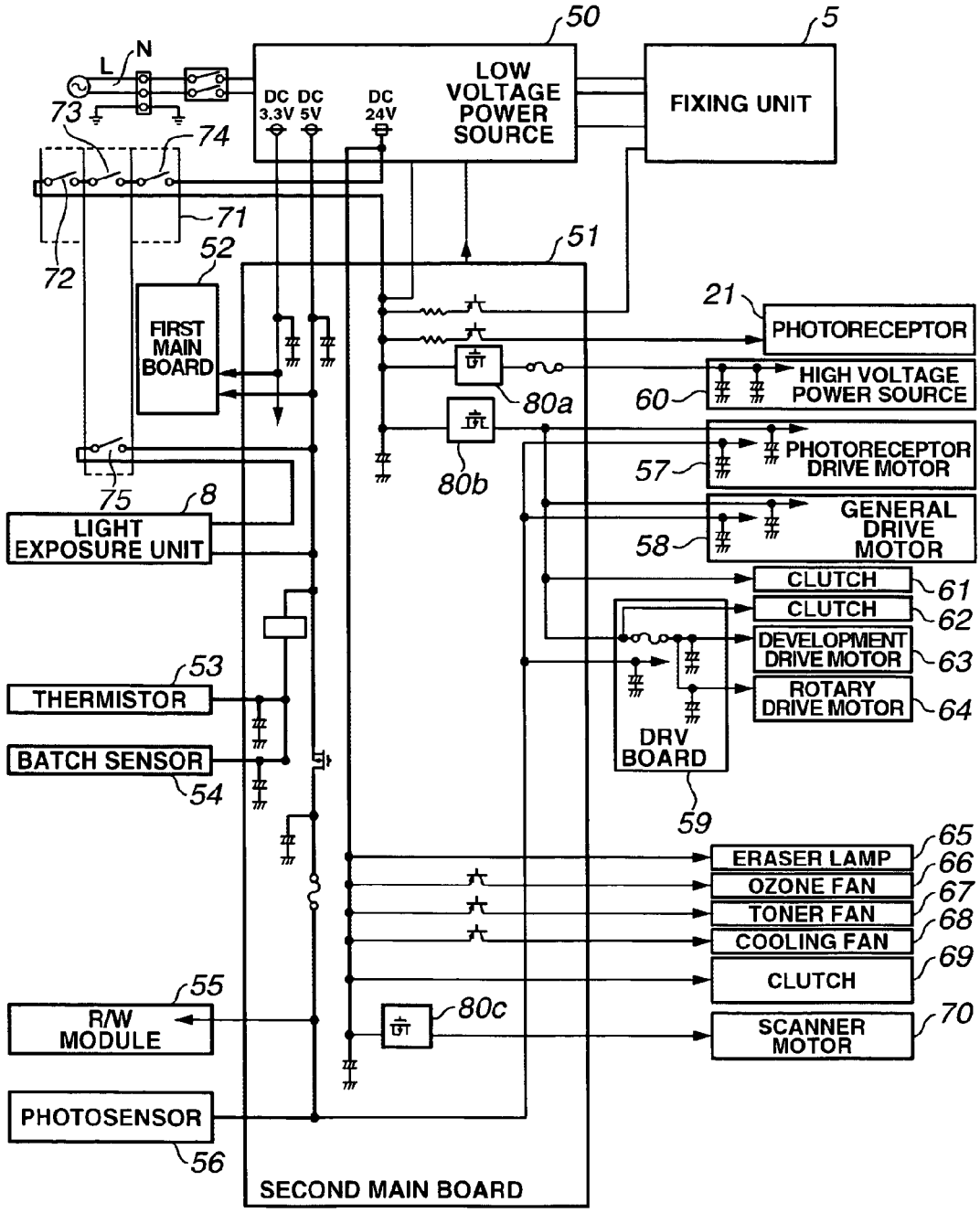
FIG. 2 is a block diagram illustrating circuit formation mainly focused on a power supply system for the image forming apparatus according to the first embodiment.

FIG. 2 is a block diagram explaining the circuit layout, mainly focusing on a power supply system of the image forming apparatus. The image forming apparatus according to this first embodiment operates by receiving supply of an alternating current (AC) voltage (100 V) from a commercial power source (AC source).

A low voltage power source 50 receives the AC voltage from the commercial power source via a power source switch and generates three kinds of direct current (DC) voltages (3.3V, 5V, and 24V). The respective power 3.3V, 5V, and 24V is supplied via a second main board 51 to each component of the image forming apparatus. For example, the 3.3V power is supplied to a first main board 52 including a main controller. The 5V power is supplied to a thermistor unit 53, a batch sensor 54, an R/W module 55, a photosensor 56, a photoreceptor drive motor unit 57, a general drive motor unit 58, and a drive circuit board (DRV board) 59 respectively. The 5V power is also supplied via a 5V interlock switch in an interlock switch unit 71, to the light exposure unit 8.

Similarly, the 24V power is supplied to the photoreceptor 21, a high voltage power source 60, the photoreceptor drive motor unit 57, the general drive motor unit 58, a secondary transfer roller adjoining clutch 61, an intermediate transfer belt cleaner adjoining clutch 62, a development drive motor unit 63, a rotary drive motor unit 64, an eraser lamp unit 65, an ozone fan unit 66, a toner fan unit 67, a cooling fan 68, a paper-feed-related clutch 69, and a scanner motor 70. Each of these components, including the high voltage power source 60, has a capacitative load. Switches using bipolar transistors or field-effect transistors are provided as appropriate on power supply paths (wires) that connect these components with the 24V power source. Also, the photoreceptor 21, the high voltage power source 60, the photoreceptor drive motor unit 57, the general drive motor unit 58, the secondary transfer roller adjoining clutch 61, the intermediate transfer belt cleaner adjoining clutch 62, the development drive motor unit 63, and the rotary drive motor unit 64 receive the supply of the 24V power via 24V interlock switches 72, 73, and 74 in the interlock switch unit 71. Accordingly, when a cover, such as a full-face cover or a side-face cover, of the image forming apparatus is opened, each interlock switch opens in conjunction with the opening action of the cover, thereby stopping the 24V power supply.

Incidentally, the eraser lamp unit 65, the ozone fan unit 66, the toner fan unit 67, the cooling fan 68, and the paper-feed-related clutch 69 correspond to the "first drive unit." The photoreceptor 21, the high voltage power source 60, the photoreceptor drive motor unit 57, the general drive motor unit 58, the secondary transfer roller adjoining clutch 61, the intermediate transfer belt cleaner adjoining clutch 62, the development drive motor unit 63, the rotary drive motor unit 64, and the scanner motor 70 correspond to the "second drive unit." The interlock switch unit 71 corresponds to the "switch."

In the first embodiment, a power supply control circuit 80*a* containing a field-effect transistor is provided on the supply path connecting the high voltage power source 60 as the "second drive unit" with the 24V power source. Also, a power supply control circuit 80*b* containing a field-effect transistor is provided on the supply path connecting the photoreceptor drive motor unit 57, the general drive motor unit 58, the secondary transfer roller adjoining clutch 61, the intermediate transfer belt cleaner adjoining clutch 62, the development drive motor unit 63, and the rotary drive motor unit 64, respectively with the 24V power source. These power supply control circuits 80*a* and 80*b* are provided on the power supply paths between the interlock switch unit 71 and the respective drive units, and switch whether or not the electric power is supplied to the drive units under the control of the first main board 52 as control means, and inhibit inflow of an inrush current into the drive units when the interlock switch unit 71 becomes conductive. Consequently, it is possible to prevent an excessive inrush current from flowing into the drive units when opening and closing the cover, such as a full-face cover or a side-face cover, of the image forming apparatus. Moreover, a power supply control circuit 80*c* containing a field-effect transistor is provided on the supply path connecting the scanner motor 70 as the "second drive unit" with the 24V power source.

Figure 3:
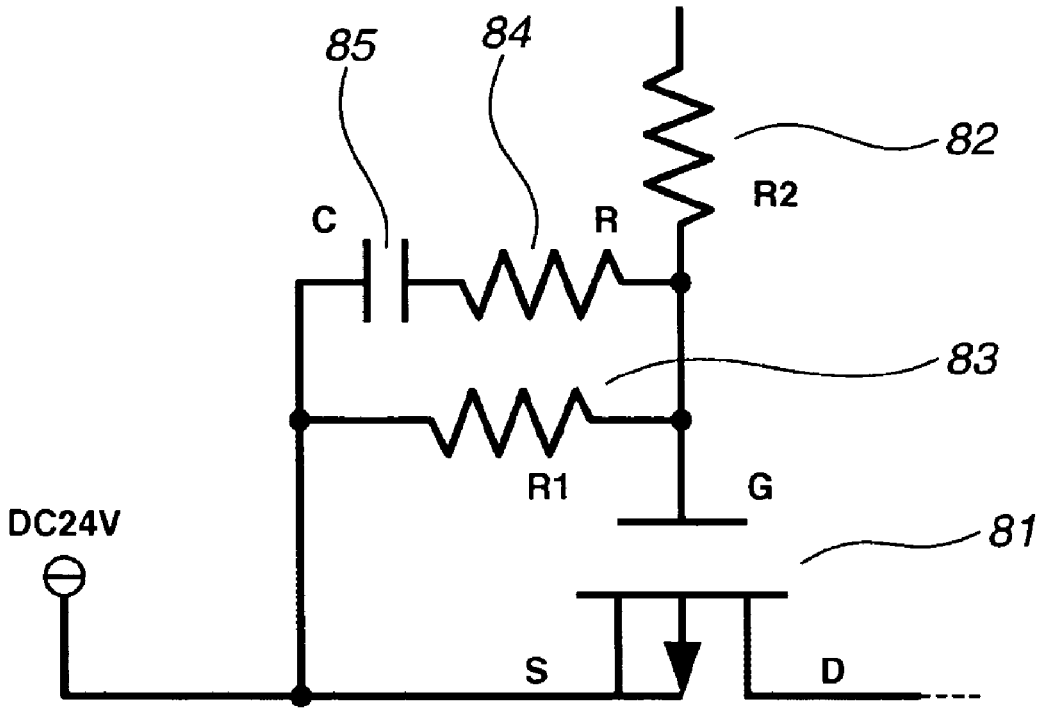
FIG. 3 is a circuit diagram illustrating the detailed configuration of a power supply control circuit according to the first embodiment.

FIG. 3 is a circuit diagram explaining the detailed configuration of the power supply control circuit 80*a*. The power supply control circuit 80*a* shown in FIG. 3 includes a field-effect transistor 81, resistive elements 82, 83, and 84, and a capacitive element 85. The source of the field-effect transistor 81 is connected to the power source (DC 24V) side of the power supply path, and its drain is connected to the drive unit side of the power supply path. In this example, a P-channel enhancement MOSFET is used as the field-effect transistor 81. the resistive element 83 (first resistive element) is connected between the gate and source of the field-effect transistor 81, works together with the resistive element 82 to divide the voltage from the power source, and generates an appropriate gate voltage (12V in this example). The resistive element 84 (second resistive element) and the capacitive element 85 are connected in series with each other and also connected in parallel with the resistive element 83, and are located between the gate and source of the field-effect transistor 81. The resistance value and capacitance value of the elements are set, for example, as follows: the resistive elements 82 and 83, each with the resistance value 100 kΩ, the resistive element 84 with the resistive value 27 kΩ, and the capacitative element 85 with the capacitance value 0.1 μF.

The power supply control circuits 80*b* and 80*c* are configured in a manner similar to those of the power supply circuit 80*a*.

Figure 4:
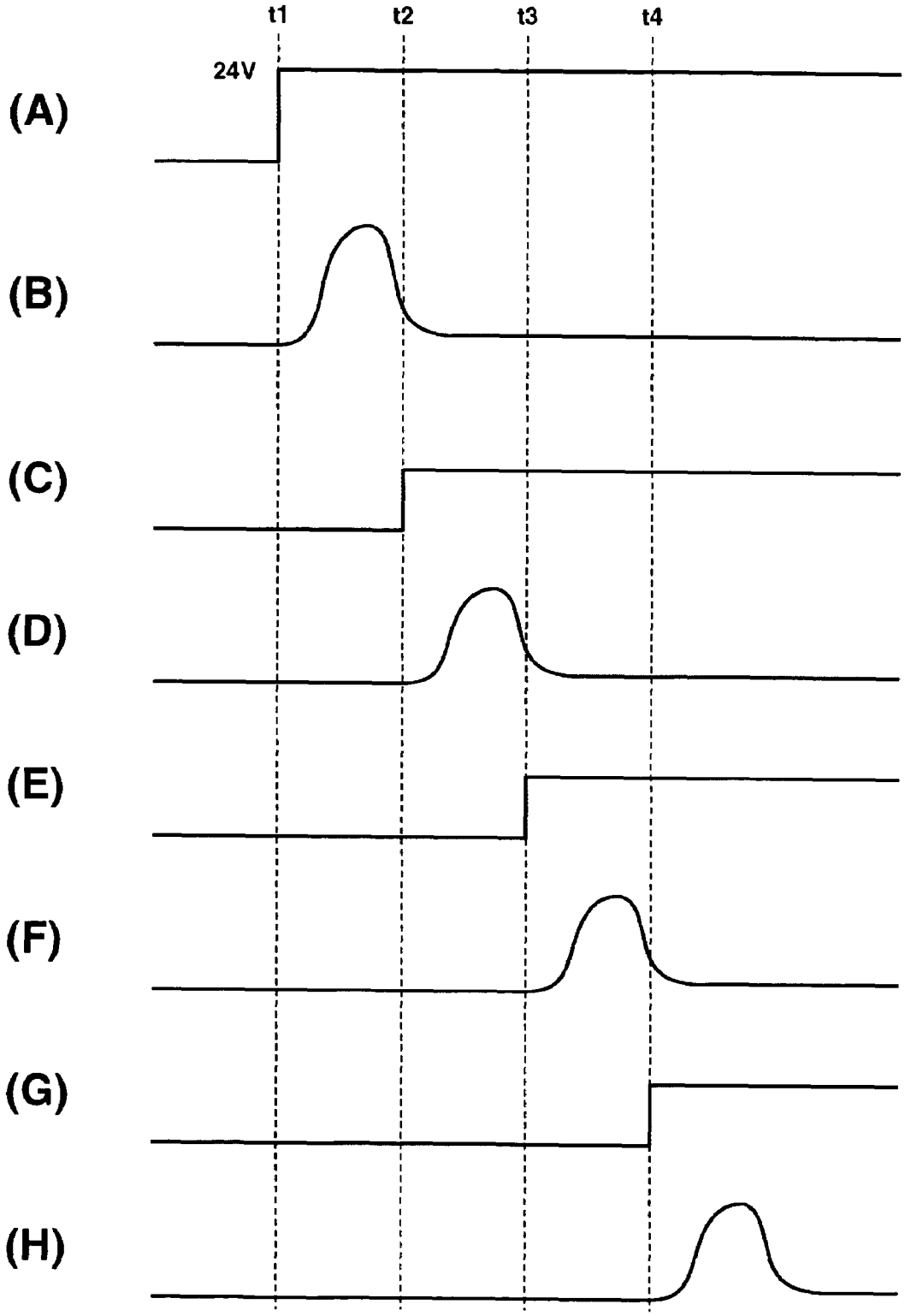
FIG. 4 is a waveform chart explaining power supply timing according to the first embodiment.

FIG. 4 shows waveform charts schematically explaining power supply timing. As shown in waveform chart (A), when the interlock switch unit 71 enters the ON state and the voltage is applied to the switch from the 24V power source at time t1, the eraser lamp unit 65 and other components, as the first drive unit, have their capacitive loads charged at that time t1, generating an inrush current, and then return to the steady state as shown in waveform chart (B). Next, at time t2 as shown in waveform chart (C), a specified voltage is applied to the gate of the field-effect transistor 81 included in the power supply control circuit 80*b*, and the transistor 81 enters the ON state. Consequently, as shown in waveform chart (D), the photoreceptor drive motor unit 57 and other components, as the second drive unit, have their capacitative loads charged, generating an inrush current, and then return to the steady state. Subsequently, at time t3 as shown in waveform chart (E), a specified voltage is applied to the gate of the field-effect transistor 81 included in the power supply control circuit 80*c*, and the transistor 81 enters the ON state. Consequently, as shown in waveform chart (F), the scanner motor 70, as the second drive unit, has its capacitative load charged, generating an inrush current, and then returns to the steady state. Next at time t4 as shown in waveform chart (G), a specified voltage is applied to the gate of the field-effect transistor 81 included in the power supply control circuit 80*a*, and the transistor 81 enters the ON state. Consequently, as shown in waveform chart (H), the high voltage power source 60, as the second drive unit, has its capacitative load charged, generating an inrush current, and then returns to the steady state.

Since the power supply control circuits 80*a*, 80*b*, and 80*c* are provided in the first embodiment, it is possible to prevent the passage of an inrush current when the field-effect transistor 81 turns on for a moment in the state where the interlock switch unit 71 enters the ON state and the 24V power is on. Because the series circuit formed by the resistive element 84 and the capacitative element 85 is provided, when the interlock switch unit 71 is turned on, no potential difference occurs between the gate and source of the field-effect transistor 81, and electric current does not pass through the field-effect transistor 81 immediately. As a result, it is possible to prevent unexpected power supply to the second drive unit, and also prevent the occurrence of an excessive inrush current. Moreover, because of the series circuit formed by the resistive element 84 and the capacitative element 85, it is possible to moderate the switching speed of the field-effect transistor 81, reduce the inrush current while the field-effect transistor 81 is in the ON state, and inhibit a leakage current.

Second Embodiment

Figure 5:
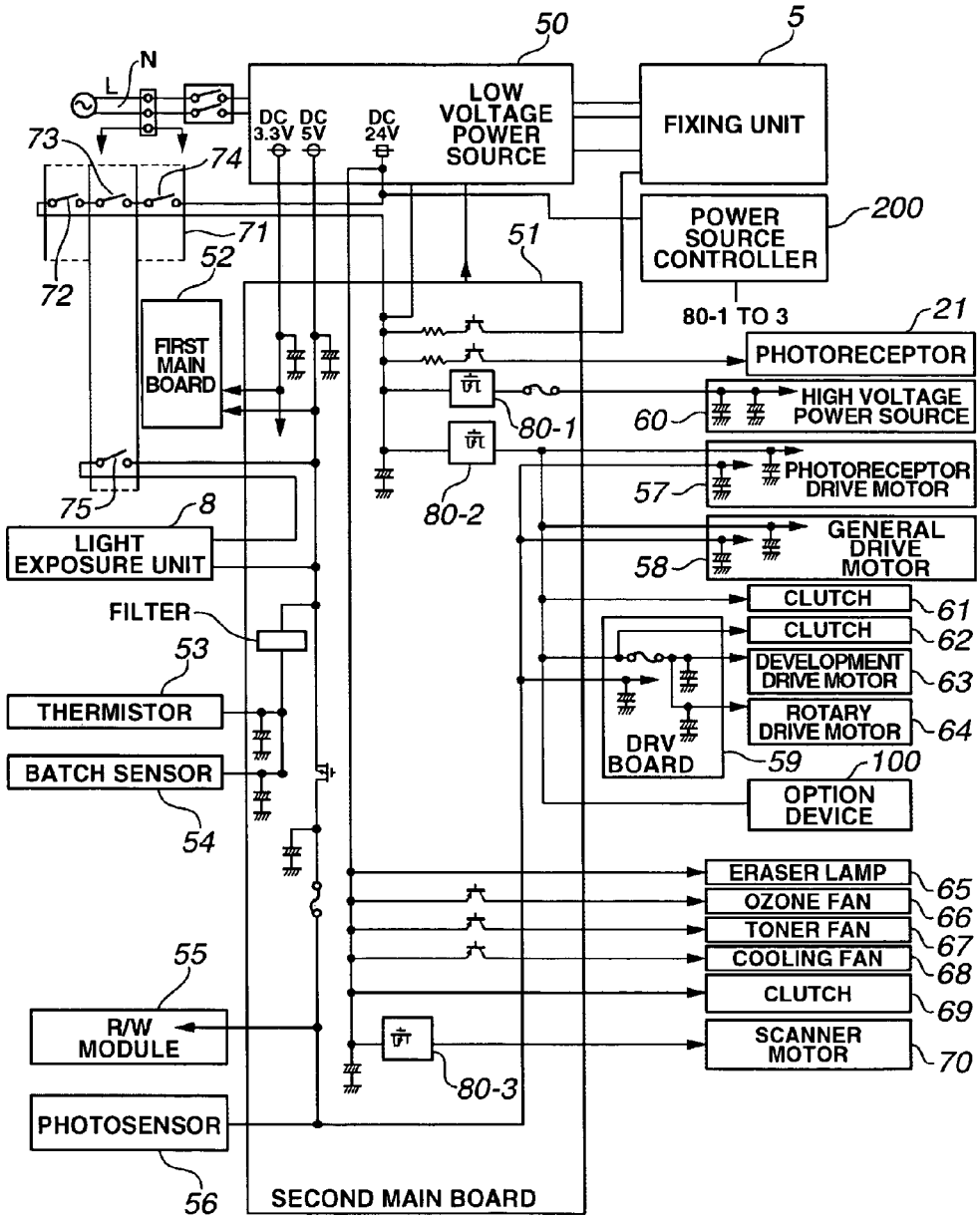
FIG. 5 is a block diagram illustrating the circuit configuration mainly focused on an image forming apparatus according to a second embodiment of the invention.

FIG. 5 is a block diagram explaining the circuit configuration, mainly focusing on a power supply system for an image forming apparatus according to a second embodiment of the invention. The image forming apparatus according to this second embodiment operates by receiving the supply of an alternating current (AC) voltage (100 V) from a commercial power source (AC source). In the following description, the parts overlapping with the description of the first embodiment are omitted.

A low voltage power source 50 receives the AC voltage from the commercial power source via a power source switch and generates three kinds of direct current (DC) voltages (3.3V, 5V, and 24V), which are examples of drive voltages. The respective power 3.3V, 5V, and 24V is supplied via a second main board 51 to each component of the image forming apparatus. For example, the 3.3V power is supplied to a first main board 52 including a main controller. The 5V power is supplied to a thermistor unit 53, a batch sensor 54, an R/W module 55, a photosensor 56, a photoreceptor drive motor unit 57, a general drive motor unit 58, and a drive circuit board (DRV board) 59 respectively. The 5V power is also supplied via a 5V interlock switch in an interlock switch unit 71, to a light exposure unit 8.

Similarly, the 24V power is supplied to the photoreceptor 21, a high voltage power source 60, the photoreceptor drive motor unit 57, the general drive motor unit 58, a secondary transfer roller adjoining clutch 61, an intermediate transfer belt cleaner adjoining clutch 62, a development drive motor unit 63, a rotary drive motor unit 64, an eraser lamp unit 65, an ozone fan unit 66, a toner fan unit 67, a cooling fan 68, a paper-feed-related clutch 69, and a scanner motor 70 respectively. Each of these components, including the high voltage power source 60, has a capacitative load. Switches using bipolar transistors or field-effect transistors are provided as appropriate on power supply paths (wires) that connect these components with the 24V power source. Also, the photoreceptor 21, the high voltage power source 60, the photoreceptor drive motor unit 57, the general drive motor unit 58, the secondary transfer roller adjoining clutch 61, the intermediate transfer belt cleaner adjoining clutch 62, the development drive motor unit 63, and the rotary drive motor unit 64 receive the supply of the 24V power via 24V interlock switches 72, 73, and 74 in the interlock switch unit 71. Accordingly, when a cover, such as a full-face cover or a side-face cover, of the image forming apparatus is opened, each interlock switch opens in conjunction with the opening action of the cover, thereby stopping the 24V power supply.

In the second embodiment, a power supply control circuit 80-1 containing a field-effect transistor (FET) is provided on the supply path connecting the high voltage power source 60 with the 24V power source. Also, a power supply control circuit 80-2 is provided on the supply path connecting the photoreceptor drive motor unit 57, the general drive motor unit 58, the secondary transfer roller adjoining clutch 61, the intermediate transfer belt cleaner adjoining clutch 62, the development drive motor unit 63, and the rotary drive motor unit 64, all of which are examples of an engine unit, respectively with the 24V power source. Moreover, a power supply control circuit 80-3 containing a field-effect transistor is provided on the supply path connecting the scanner motor 70 as a "drive unit" with the 24V power source. These power supply control circuits 80-1 to 80-3 are provided on the power supply paths extending between the interlock switch unit 71 and the respective drive units, switch whether or not the power is supplied to the drive units under the control of the first main board 52 which is a control means, and inhibit inflow of an inrush current into the drive units when the interlock switch unit 71 becomes conductive. Consequently, it is possible to prevent an excessive inrush current from flowing into the drive units when opening and closing the cover, such as a full-face cover or a side-face cover, of the image forming apparatus.

Figure 6:
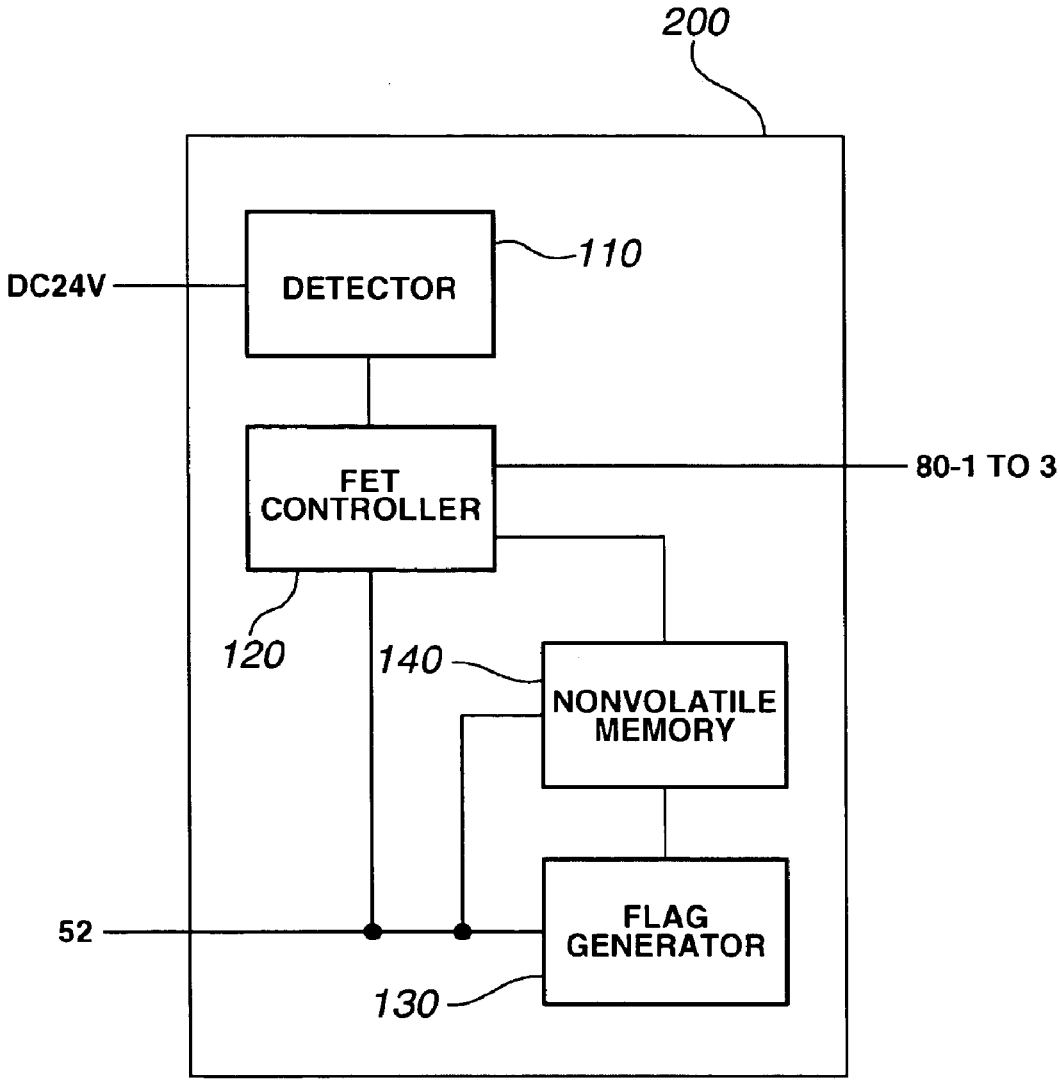
FIG. 6 is a block diagram illustrating the configuration of a power supply control unit according to the second embodiment.

FIG. 6 is a block diagram illustrating the configuration of a power source controller 200. The power source controller 200 includes a detector 100, an FET controller 120, a flag controller 130, and nonvolatile memory 140.

The detector 110 detects voltage fluctuation of the 24V power. In the second embodiment, when the voltage becomes lower than a predetermined threshold voltage value (such as 21.6V), the detector 110 judges that the 24V power has fluctuated, and notifies the FET controller 120 to that effect. The FET controller 120 controls, in accordance with an instruction from the main board 52 or the notification from the detector 110, whether the FET included in the power supply control circuit 80 is turned on or off. The flag controller 130 generates a flag in the nonvolatile memory 140 or clears the generated flag in accordance with an instruction from the main board 52 and/or the FET controller 120.

Figure 7:
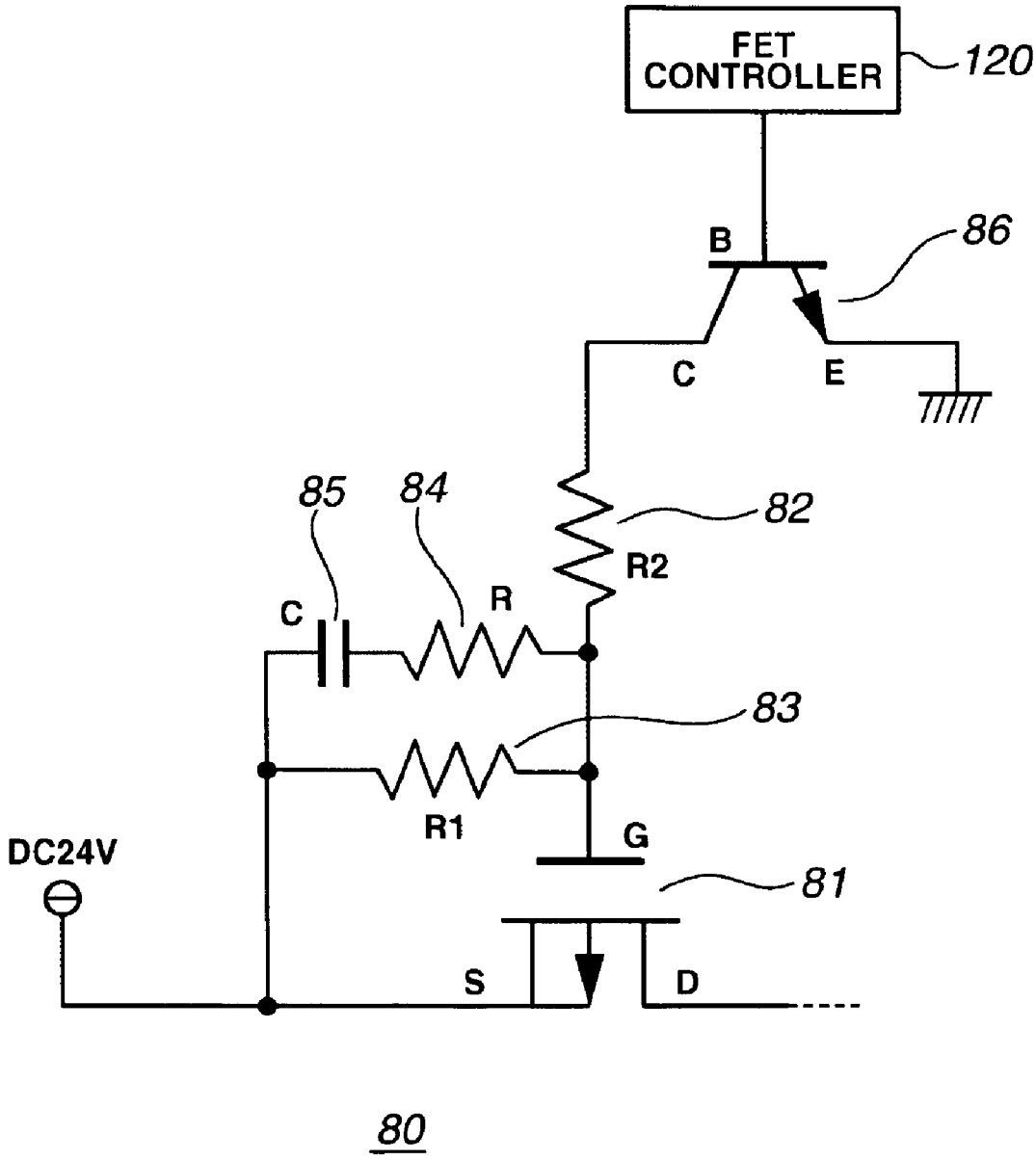
FIG. 7 is a circuit diagram illustrating the detailed configuration of a power supply control circuit according to the second embodiment.

FIG. 7 is a circuit diagram explaining the detailed configuration of the power supply control circuits 80-1 to 80-3. The power supply control circuit 80 shown in FIG. 7 includes an FET 81, resistive elements 82, 83, and 84, a capacitative element 85, and a bipolar transistor 86. The source of the FET 81 is connected to the power source (DC 24V) side of the power supply path, and its drain is connected to the drive unit side of the power supply path. In this example, a P-channel enhancement MOSFET is used as the FET 81. The resistive element 83 (first resistive element) is connected between the gate and source of the FET 81, works together with the resistive element 82 to divide the voltage from the power source, and generates an appropriate gate voltage (12V in this example). The resistive element 84 (second resistive element) and the capacitative element 85 are connected in series with each other and also connected in parallel with the resistive element 83 and located between the gate and source of the FET 81. The resistance value and the capacitance value of the respective elements are set, for example, as follows: the resistive elements 82 and 83, each with the resistance value 100 kΩ, the resistive element 84 with the resistive value 27 kΩ, and the capacitative element 85 with the capacitance value 0.1 μF.

The collector of the bipolar transistor 86 is connected via the resistive element 82 to the gate of the FET 81, its emitter is grounded, and its base is connected to the FET controller 120. Under the control of the FET controller 120, the bipolar transistor 86 controls the gate voltage of the FET 81. Specifically speaking, when turning on the FET 81, the FET controller 120 sets the base voltage to 5V to have the bipolar transistor 86 enter the ON state, and decreases the gate voltage of the FET 81. On the other hand, when turning off the FET 81, the FET controller 120 sets the base voltage to 0V to have the bipolar transistor 86 enter the OFF state, and increases the gate voltage of the FET 81.

Figure 8:
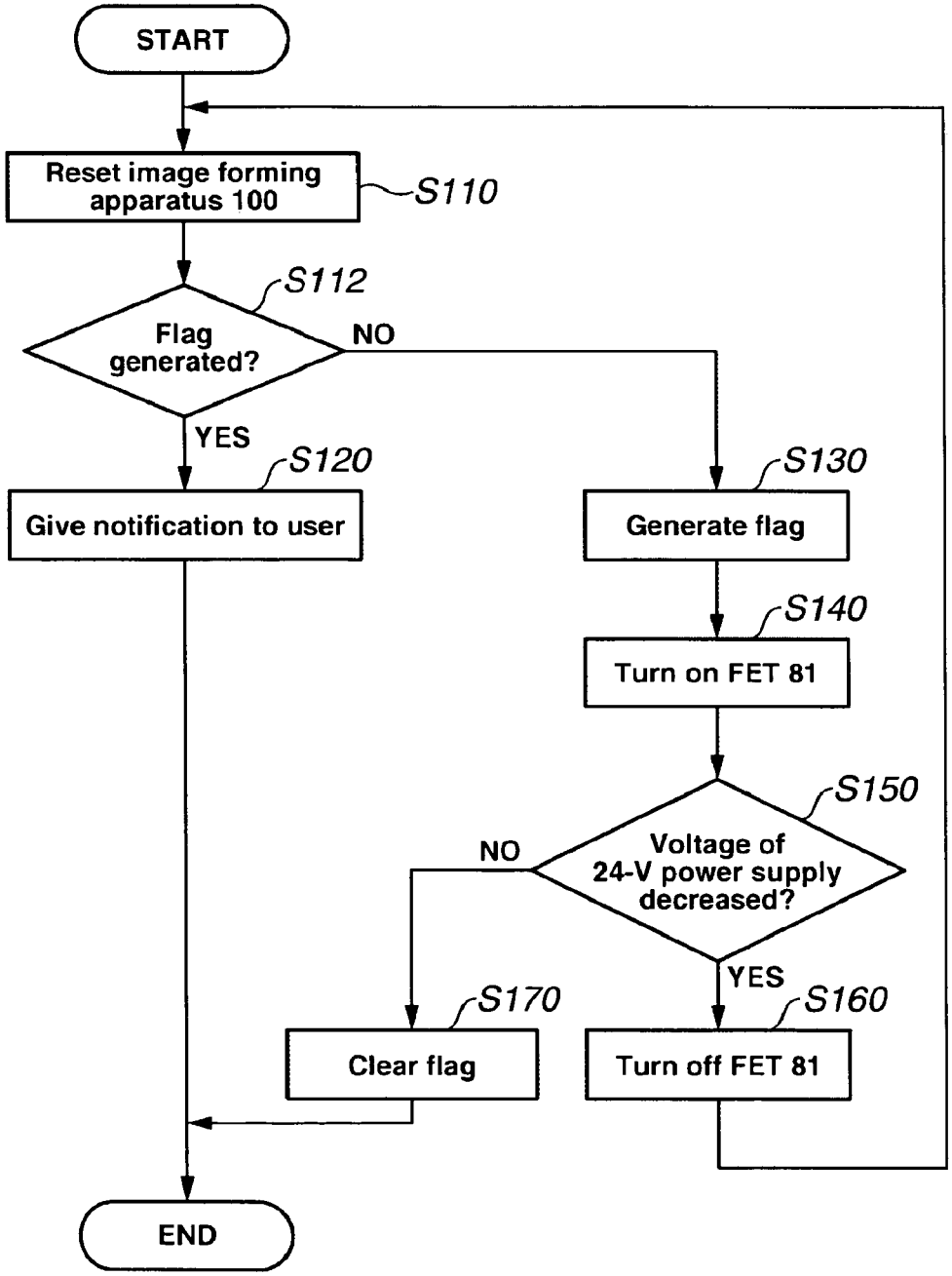
FIG. 8 is a flowchart showing an example of one operation of the image forming apparatus according to the second embodiment.

FIG. 8 is a flowchart showing an example of one operation of the image forming apparatus according to the second embodiment. An example of the operation of the image forming apparatus according to the second embodiment in the case where fluctuation of the 24V power supply has occurred will be described below with reference to FIGS. 5 to 8. In this example, the operation of the image forming apparatus will be explained for the case where the power supply control circuit 80-2 supplies the 24V power to an optional device 100, an example of the engine unit, in the situation where a user has incorrectly connected the optional device 100 to the image forming apparatus and a short circuit has occurred in the optional device 100.

When the image forming apparatus is reset, for example, when starting the image forming apparatus (S110), the flag controller 130 checks whether a flag has been generated in the nonvolatile memory 140 or not (S112).

If a flag has been generated in the nonvolatile memory 140 (S112: Yes), the flag controller 130 notifies the main board 52 to that effect, and the main board 52 then notifies the user that there is an error, for example, in a component connected downstream of the power supply control circuit 80-2, by displaying a notice on a display unit such as a liquid crystal display (S120).

On the other hand, if no flag is generated in the nonvolatile memory (S112: NO), the flag controller 130 generates a flag in the nonvolatile memory (S130), and the FET controller 120 turns on the FET 81 of the power supply control circuit 80-2. Incidentally, the FET controller 120 may turn the FET 81 on almost at the same time as the flag controller 130 generates the flag.

When the FET 81 of the power supply control circuit 80-2 enters the ON state, the 24V power is supplied to the optional device 100. Since a short circuit has occurred in the optional device 100, an abnormal current passes through the optional device 100 and the voltage of the 24V power supply decreases. If the voltage of the 24V power supply decreases to 21.6V or lower, the detector 110 judges that the voltage of the 24V power supply has decreased, and notifies the FET controller 120 to that effect.

When the voltage of the 24V power supply decreases, the FET controller 120 turns off the FET 81 of the power supply controller circuit 80-2 (S160). Specifically speaking, the FET controller 120 sets the base voltage of the bipolar transistor 86 to 0V to turn the bipolar transistor 86 off, and then increases the gate voltage of the FET 81. Consequently, the gate voltage of the FET 81 exceeds its threshold voltage and the FET 81 enters the OFF state.

After the FET 81 has been turned off and the image forming apparatus has been reset (S110), the flag controller 130 checks again whether a flag has been generated in the nonvolatile memory 140 or not (S112). Since the image forming apparatus is reset in S110 in the state where the flag generated in S130 is stored in the nonvolatile memory 140, the flag controller 130 notifies the main board 52 that the flag has been generated in the nonvolatile memory 140, and the main board 52 notifies the user to that effect (S120).

On the other hand, if the voltage of the 24V power supply does not decrease (S150: No) after the FET 81 of the power supply control circuit 80-2 has been turned on (S140), the flag controller 130 clears the flag generated in the nonvolatile memory in S130 (S170), and the image forming apparatus stands by for an external print instruction. If the voltage of the 24V power supply does not increase for, for example, a certain period of time (such as 200 ms) after the FET 81 has been turned on, the flag controller 130 judges that there is no error downstream of the FET 81, and then clears the flag.

In the image forming apparatus according to the second embodiment, a flag is generated in the nonvolatile memory 14 when turning on the FET 81; and if there is no error after the FET 81 has been turned on, the flag is cleared. If an error occurs when the FET 81 is on, the FET 81 is turned off in the state where the flag has been generated. Accordingly, by checking the flag state when resetting the image forming apparatus, the user can judge whether or not an error occurred before the reset. Therefore, since the image forming apparatus according to the second embodiment can confirm that there is the possibility of occurrence of an error if the FET were to be turned on again, it is possible to prevent the image forming apparatus from being repeatedly reset due to the occurrence of an error.

Figure 9:
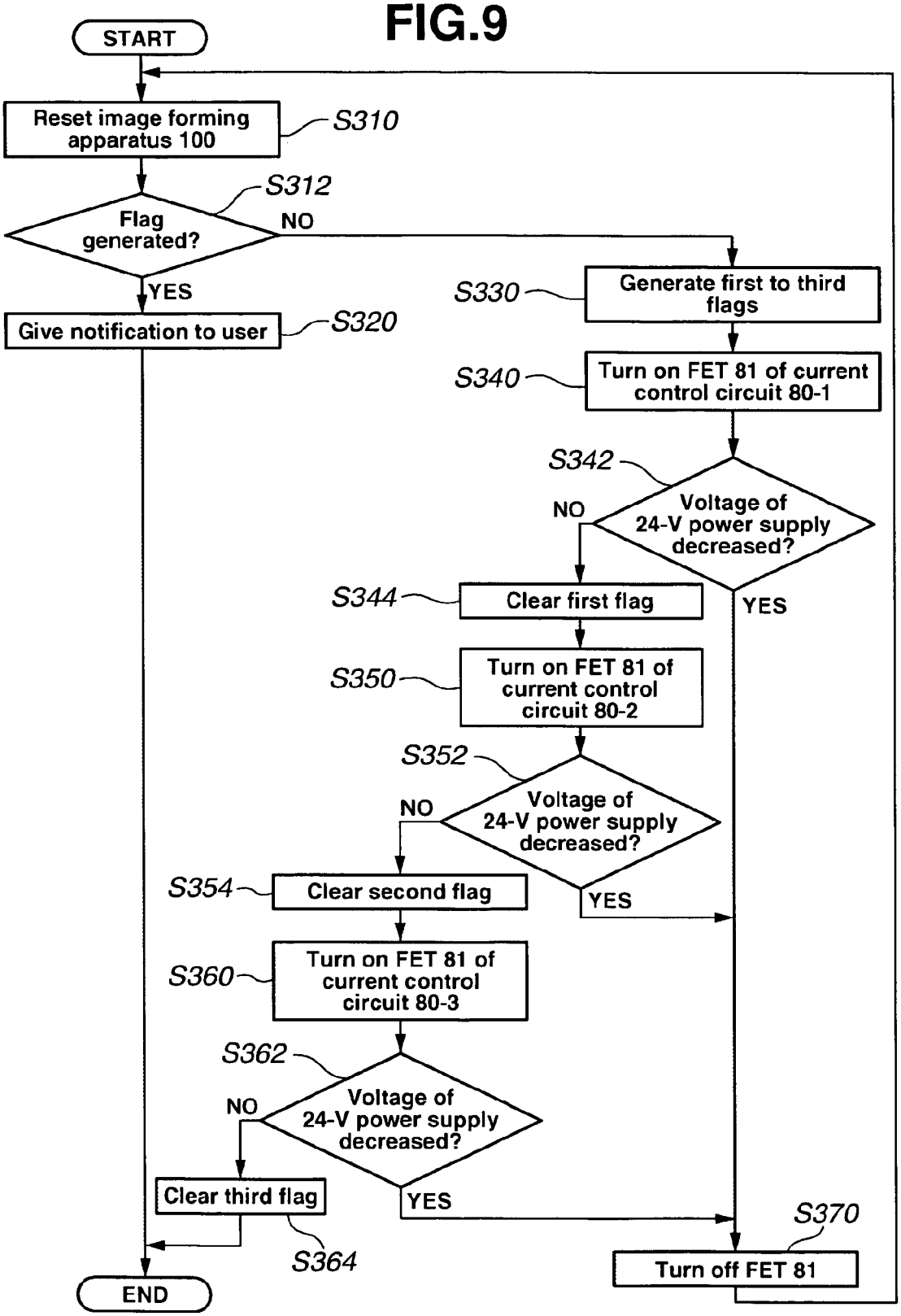
FIG. 9 is a flowchart showing an example of another operation of the image forming apparatus according to the second embodiment.

FIG. 9 is a flowchart showing an example of another operation of the image forming apparatus according to the second embodiment. Another example of the operation of the image forming apparatus according to the second embodiment in the case where fluctuation of the 24V power supply has occurred will be described below with reference to FIGS. 5 to 7, and FIG. 9. In this example, the FET controller 120 turns on the FETs 81 of the power supply control circuits 80-1 to 80-3 sequentially and the 24V power is sequentially supplied to each component of the engine unit.

When the image forming apparatus is reset, for example, when starting the image forming apparatus (S310), the flag controller 130 checks whether a flag has been generated in the nonvolatile memory 140 or not (S312).

If a flag has been generated in the nonvolatile memory 140 (S312: Yes), the flag controller 130 notifies the main board 52 to that effect, and the main board 52 then notifies the user that there is an error, for example, in a component connected downstream of the power supply control circuit 80-2, by displaying a notice on a display unit such as a liquid crystal display (S320).

On the other hand, if no flag is generated in the nonvolatile memory (S312: NO), the flag controller 130 generates first to third flags in the nonvolatile memory 140 corresponding to the power supply control circuits 80-1 to 80-3 (S330). The FET controller 120 first turns on the FET 81 of the power supply control circuit 80-1 (S340).

If the voltage of the 24V power supply decreases after the FET 81 of the power supply control circuit 80-1 has been turned on (S342: Yes), the FET controller 120 turns off the FETs 81 of the power supply control circuits 80-1 to 80-3 (S370).

After the FETs 81 have been turned off and the image forming apparatus has been reset (S310), the flag controller 130 checks again whether a flag has been generated in the nonvolatile memory 140 or not (S312). Since the image forming apparatus is reset in S310 in the state where the first to third flags generated in S330 are stored in the nonvolatile memory 140, the flag controller 130 notifies the main board 52 that the first to third flags have been generated in the nonvolatile memory 140. Then, since the first to third flags have been generated, the main board 52 judges that an error has occurred downstream of the power supply control circuit 80-1, and notifies the user to that effect (S320).

On the other hand, if the voltage of the 24V power supply does not decrease (S342: No) after the FET 81 of the power supply control circuit 80-1 has been turned on (S340), the flag controller 130 judges that there is no error downstream of the power supply control circuit 80-1, and then clears the first flag generated in the nonvolatile memory 140 in S330 (S344).

Next, the FET controller 120 turns on the FET 81 of the power supply control circuit 80-2 (S350). If the voltage of the 24V power supply decreases after the FET 81 of the power supply control circuit 80-2 has been turned on (S352: Yes), the FET controller 120 turns off the FETs 81 of the power supply control circuits 80-1 to 80-3 (S370).

After the FETs 81 have been turned off and the image forming apparatus has been reset (S310), the flag controller 130 checks again whether a flag has been generated in the nonvolatile memory 140 or not (S312). Since the image forming apparatus is reset in S310 in the state where the second and third flags generated in S330 are stored in the nonvolatile memory 140, the flag controller 130 notifies the main board 52 that the second and third flags have been generated in the nonvolatile memory 140. Then, since the second and third flags have been generated, the main board 52 judges that an error has occurred downstream of the power supply control circuit 80-2, and notifies the user to that effect (S320).

On the other hand, if the voltage of the 24V power supply does not decrease (S352: No) after the FET 81 of the power supply control circuit 80-2 has been turned on (S350), the flag controller 130 judges that there is no error downstream of the power supply control circuit 80-2, and then clears the second flag generated in the nonvolatile memory 140 in S330 (S354).

Subsequently, the FET controller 120 turns on the FET 81 of the power supply control circuit 80-3 (S360). If the voltage of the 24V power supply decreases after the FET 81 of the power supply control circuit 80-3 has been turned on (S362: Yes), the FET controller 120 turns off the FETs 81 of the power supply control circuits 80-1 to 80-3 (S370).

After the FETs 81 have been turned off and the image forming apparatus has been reset (S310), the flag controller 130 checks again whether a flag has been generated in the nonvolatile memory 140 or not (S312). Since the image forming apparatus is reset in S310 in the state where the third flag generated in S330 is stored in the nonvolatile memory 140, the flag controller 130 notifies the main board 52 that the third flag has been generated in the nonvolatile memory 140. Then, since the third flag has been generated, the main board 52 judges that an error has occurred downstream of the power supply control circuit 80-3, and notifies the user to that effect (S320).

Meanwhile, if the voltage of the 24V power supply does not decrease (S362: No) after the FET 81 of the power supply control circuit 80-3 has been turned on (S360), the flag controller 130 judges that there is no error downstream of the power supply control circuit 80-3, and then clears the third flag generated in the nonvolatile memory 140 in S330 (S364). As a result, all the first to third flags are cleared and the image forming apparatus stands by for an external print instruction.

Through the described operations, the image forming apparatus according to the second embodiment can identify the location where the error has occurred, out of the components connected to the plural FETs, and notify the user to that effect.

Third Embodiment

For the third embodiment, an explanation will be given about the example where the power source controller 200 includes the detector 110 and the FET controller 120. In the following description, any parts overlapping with the descriptions of the first and second embodiments will be omitted.

Figure 10:
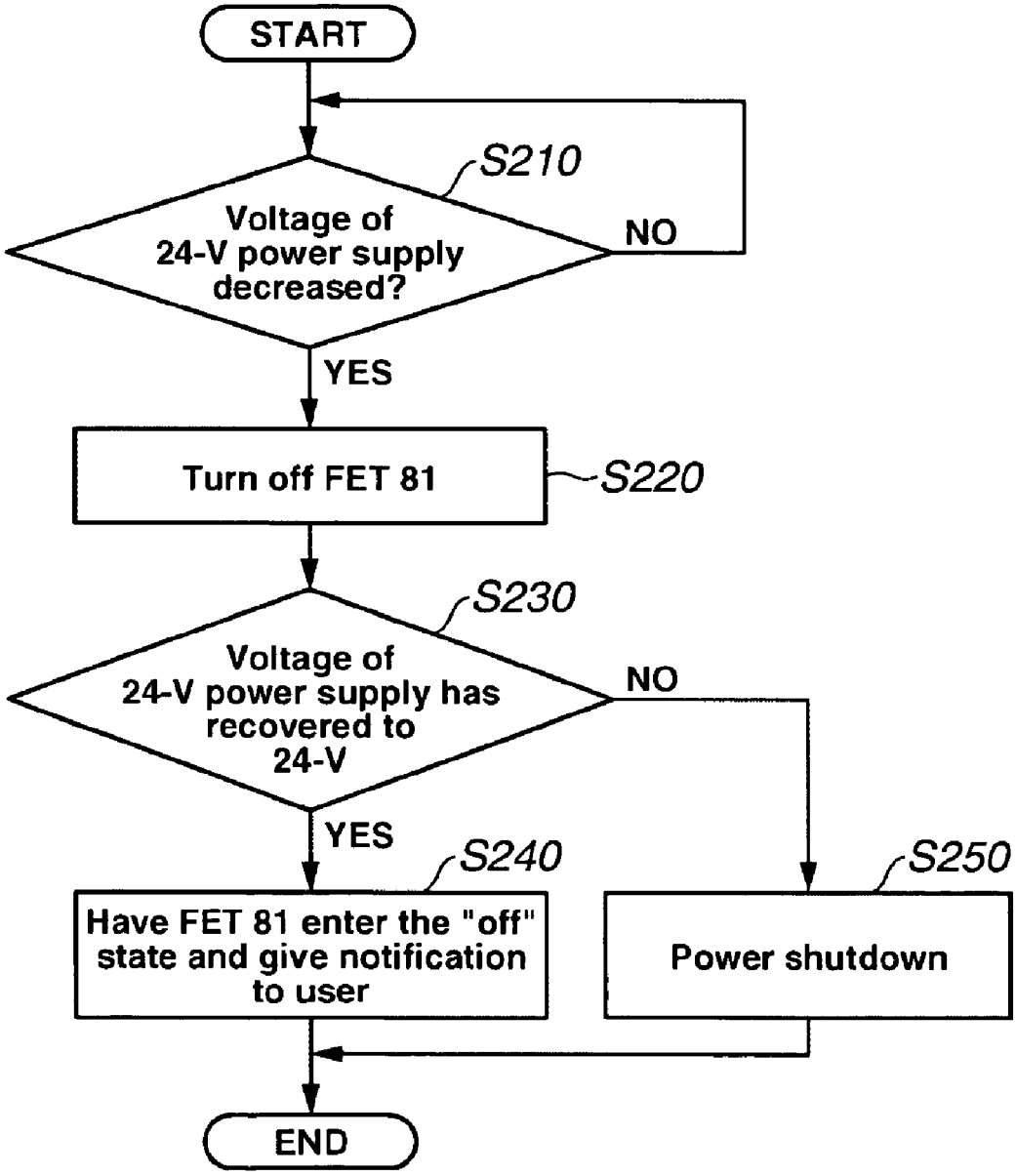
FIG. 10 is a flowchart showing an example of one operation of the image forming apparatus according to a third embodiment of the invention.

FIG. 10 is a flowchart showing an example of one operation of the image forming apparatus according to the third embodiment. An example of the operation of the image forming apparatus in the case where fluctuation of the 24V power supply has occurred will be described below with reference to FIGS. 7 and 10. In this example, the operation of the image forming apparatus will be explained about the case where the power supply control circuit 80-2 supplies the 24V power to the optional device 100 in the situation where the user has incorrectly connected the optional device 100 to the image forming apparatus and a short circuit has occurred in the optional device 100.

When the FET 81 of the power supply control circuit 80-2 enters the ON state, the 24V power is supplied to the optional device 100. Since a short circuit has occurred in the optional device 100, an abnormal current passes through the optional device 100 and the voltage of the 24V power supply decreases. If the voltage of the 24V power supply decreases to 21.6V or lower, the detector 110 judges that the voltage of the 24V power supply has decreased, and notifies the FET controller 120 to that effect (S210: Yes). If the voltage of the 24V power supply is higher than 21.6V, the detector judges that the 24V power supply is stable, and then continues checking (S210: No).

If the voltage of the 24V power supply decreases, the FET controller 120 turns off the FET 81 of the power supply controller circuit 80-2. Specifically speaking, the FET controller 120 sets the base voltage of the bipolar transistor 86 to 0V to turn the bipolar transistor 86 off, and then increases the gate voltage of the FET 81. Consequently, the gate voltage of the FET 81 exceeds its threshold voltage and the FET 81 enters the OFF state.

After the FET controller 120 has turned off the FET 81 of the power supply control circuit 80-2, the 24V power is not supplied to the short-circuited optional device 100 (see FIG. 5) and the abnormal current stops. As a result, the voltage of the 24V power supply recovers to 24V (S230: Yes). If the voltage of the 24V power supply has recovered to 24V, the FET controller 120 turns the FET 81 off and judges that an error has occurred in one of the components connected to the power supply control circuit 80-2, and notifies the user to that effect (S240). On the other hand, if the voltage of the 24V power supply does not recover to 24V even after the FET controller 120 has turned the power supply control circuit 80-2 off (S230: No), the low voltage power source 50 cuts off the 24V power supply.

In the image forming apparatus according to the third embodiment, whether or not the 24V power is supplied to the engine unit is controlled depending on fluctuation of the voltage value, through the operation described above. Accordingly, even if a short circuit or leakage occurs in any of the components of the engine unit and an abnormal current is generated, it is possible to appropriately control the supply of the 24V power to each component without cutting off the 24V power supply.

Moreover, although the series circuit formed by the resistive element 84 and the capacitative element 85 inhibits a sudden increase of the abnormal current in the engine unit, it is possible to turn the FET 81 off as appropriate and control the supply of the 24V power to the engine unit.

Figure 11:
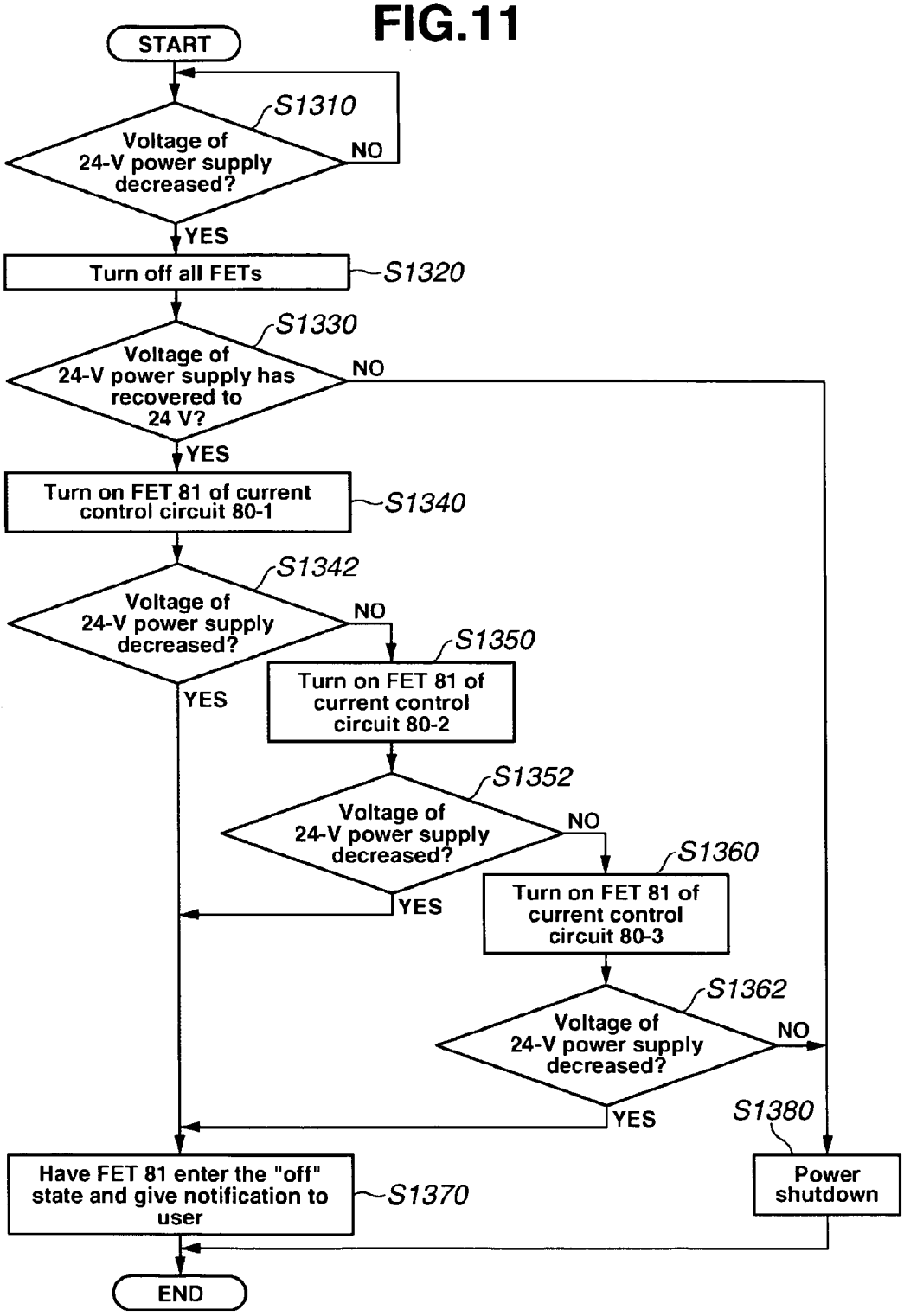
FIG. 11 is a flowchart showing an example of another operation of the image forming apparatus according to the third embodiment.

FIG. 11 is a flowchart showing another example operation of the image forming apparatus according to the third embodiment. Another example of the operation of the image forming apparatus according to the third embodiment in the case where fluctuation of the 24V power supply has occurred will be described below with reference to FIGS. 7 and 11.

When the respective FETs 81 of the power supply control circuits 80-1 to 80-3 enter the ON state, the 24V power is supplied to the engine unit. If an abnormal current occurs at this moment in any of the components connected to the power supply control circuits 80-1 to 80-3, the voltage of the 24V power supply decreases. If the voltage of the 24V power supply decreases to 21.6V or lower, the detector 110 judges that the voltage of the 24V power supply has decreased, and notifies the FET controller 120 to that effect (S1310: Yes). A case where an abnormal current occurs is, for example, when a short circuit occurs in the optional device 100 in the situation where the user has incorrectly connected the optional device 100 to the image forming apparatus.

If the voltage of the 24V power supply decreases, the FET controller 120 turns off all the FETs 81 of the power supply controller circuits 80-1 to 80-3 (S1320). Specifically speaking, the FET controller 120 sets the base voltage of the bipolar transistor 86 to 0V to turn the bipolar transistor 86 off, and then increases the gate voltage of the FETs 81. Consequently, the gate voltages of the FETs 81 exceed their threshold voltage and the FETs 81 enter the OFF state.

After the FET controller 120 has turned off the FETs 81 of the power supply control circuits 80-1 to 80-3, the 24V power is not supplied to the short-circuited optional device 100 (see FIG. 5), and the abnormal current stops. As a result, the voltage of the 24V power supply recovers to 24V (S1330: Yes). If the voltage of the 24V power supply does not recover to 24V even after the FET controller 120 has turned off all the FETs of the power supply control circuits 80-1 to 80-3 (S1330: No), the low voltage power source 50 cuts off the 24V power supply (S1380).

After the FET controller 120 has turned all the FETs 81 off and the 24V power supply has recovered to 24V, the FET controller 120 turns on the FETs 81 of the power supply control circuits 80-1 to 80-3 sequentially. In this example, the FET controller 120 first turns on the FET 81 of the power supply control circuit 80-1 (S1340).

After the FET controller 120 has turned on the FET 81 of the power supply control circuit 80-1, the detector 110 checks the voltage of the 24V power supply. If the voltage of the 24V power supply has decreased (S1342: Yes), the FET controller 120 judges that an error has occurred in one of the components connected to the power supply control circuit 80-1, turns all the FETs 81 off, and notifies the user to that effect (S1370).

On the other hand, if the voltage of the 24V power supply does not decrease (S1342: No) even after the FET 81 of the power supply control circuit 80-1 has been turned on, the FET controller 120 judges that there is no error in the components connected to the power supply control circuit 80-1. Subsequently, the FET controller 120 turns on the FET 81 of the power supply control circuit 80-2 (S1350). At this moment, the FET controller 120 may turn on the FET 81 of the power supply control circuit 80-2 after turning off the FET 81 of the power supply control circuit 80-1.

After the FET controller 120 has turned on the FET 81 of the power supply control circuit 80-2, the detector 110 checks the voltage of the 24V power supply. If the voltage of the 24V power supply has decreased (S1352: Yes), the FET controller 120 judges that an error has occurred in one of the components connected to the power supply control circuit 80-2, turns all the FETs 81 off, and notifies the user to that effect (S1370).

On the other hand, if the voltage of the 24V power supply does not decrease (S1352: No) even after the FET 81 of the power supply control circuit 80-2 has been turned on, the FET controller 120 judges that there is no error in the components connected to the power supply control circuit 80-2. Subsequently, the FET controller 120 turns on the FET 81 of the power supply control circuit 80-3 (S1360). At this moment, the FET controller 120 may turn on the FET 81 of the power supply control circuit 80-3 after turning off the FET(s) 81 of the power supply control circuit(s) 80-1 and/or 80-2.

After the FET controller 120 has turned on the FET 81 of the power supply control circuit 80-3, the detector 110 checks the voltage of the 24V power supply. If the voltage of the 24V power supply has decreased (S1362: Yes), the FET controller 120 judges that an error has occurred in one of the components connected to the power supply control circuit 80-3, turns all the FETs 81 off, and notifies the user to that effect (S1370).

On the other hand, if the voltage of the 24V power supply does not decrease (S1362: No) even after turning on the FET 81 of the power supply control circuit 80-3, i.e., even after turning on all the FETs of the power supply control circuits 80-1 to 80-3 sequentially, the FET controller 120 judges that it is impossible to identify the location where the error has occurred, and the low voltage power source 50 cuts off the 24V power supply (S1380).

Through the above-described operation, the image forming apparatus according to the third embodiment can identify the location where an error has occurred, out of the components connected to the plural FETs, and notify the user to that effect.

Figure 12:
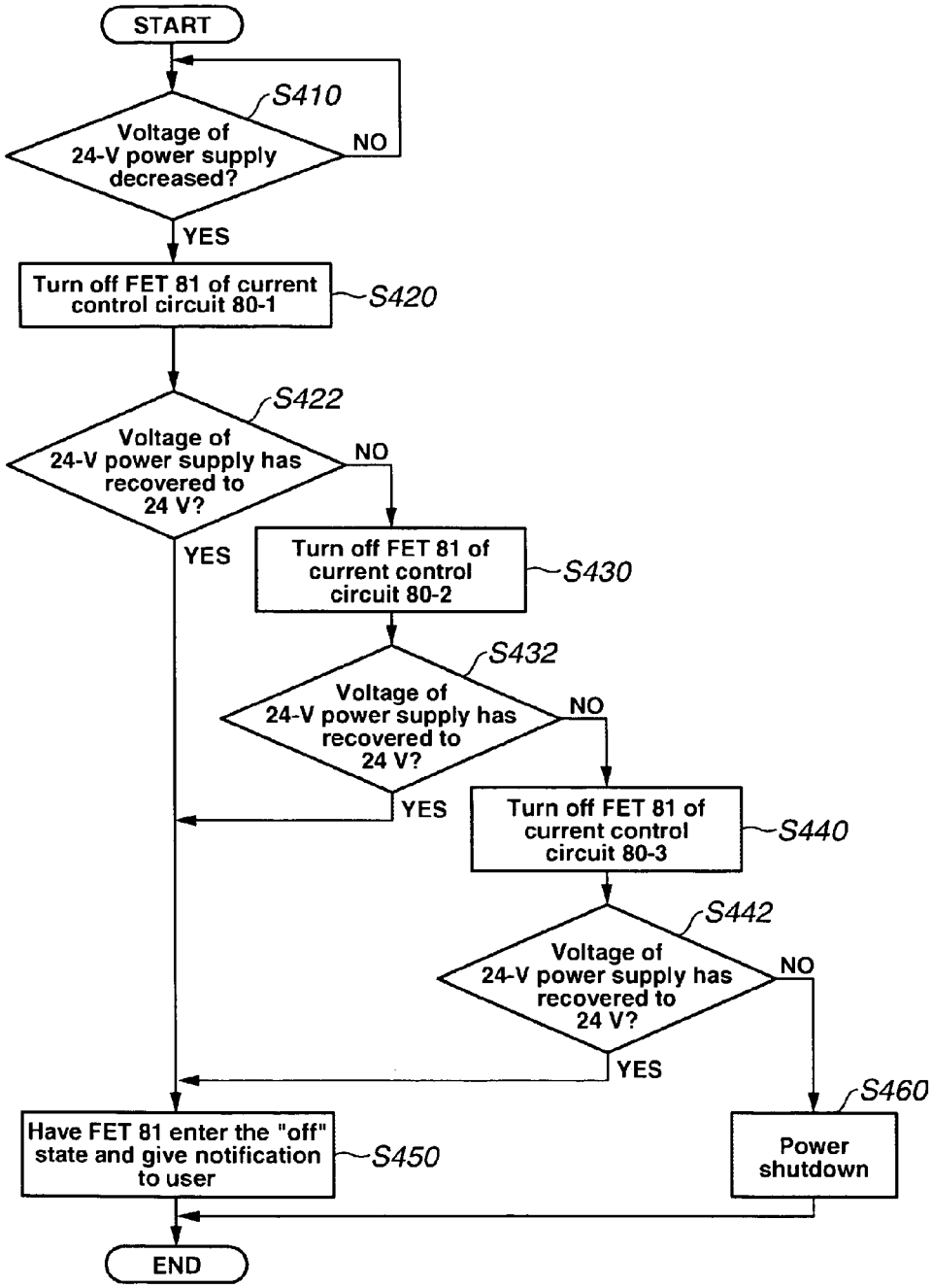
FIG. 12 is a flowchart showing an example of a further operation of the image forming apparatus according to the third embodiment.

FIG. 12 is a flowchart showing an example of a further operation of the image forming apparatus according to the third embodiment. A further example of the operation of the image forming apparatus according to the third embodiment in the case where fluctuation of the 24V power supply has occurred will be described below with reference to FIGS. 7 and 12.

When the respective FETs 81 of the power supply control circuits 80-1 to 80-3 enter the ON state, the 24V power is supplied to the engine unit. If an abnormal current occurs at this moment in any of the components connected to the power supply control circuits 80-1 to 80-3, the voltage of the 24V power supply decreases. If the voltage of the 24V power supply decreases to 21.6V or lower, the detector 110 judges that the voltage of the 24V power supply has decreased, and notifies the FET controller 120 to that effect (S410: Yes). A case where an abnormal current occurs is, for example, when a short circuit occurs in the optional device 100 in the situation where the user has incorrectly connected the optional device 100 to the image forming apparatus.

When the detector 110 detects a decrease in the voltage of the 24V power supply, the FET controller 120 sequentially turns off all the FETs 81 of the power supply controller circuits 80-1 to 80-3. In this example, the FET controller 120 first turns off the FET 81 of the power supply control circuit 80-1 (S420).

After the FET controller 120 has turned off the FET 81 of the power supply control circuits 80-1, the detector 110 checks the voltage of the 24V power supply. If the voltage of the 24V power supply has recovered to 24V (S442: Yes), the FET controller 120 judges that an error has occurred in one of the components connected to the power supply control circuit 80-1, turns all the FETs 81 off, and notifies the user to that effect (S450).

On the other hand, if the voltage of the 24V power supply does not recover to 24V even after a predetermined period of time (for example, 10 ms to 200 ms) has elapsed after turning off the FET 81 of the power supply control circuit 80-1 (S422: No), the FET controller 120 judges that there is no error in the components connected to the 24V power supply control circuit 80-1. Subsequently, the FET controller 120 turns off the FET 81 of the power supply control circuit 80-2 (S430). At this moment, the FET controller 120 may turn off the FET 81 of the power supply control circuit 80-2 after turning on the FET 81 of the power supply control circuit 80-1.

After the FET controller 120 has turned off the FET 81 of the power supply control circuit 80-2, the detector 110 checks the voltage of the 24V power supply. If the voltage of the 24V power supply has recovered to 24V (S432: Yes), the FET controller 120 judges that an error has occurred in any of the components connected to the power supply control circuit 80-2, turns all the FETs 81 off, and notifies the user to that effect (S450).

On the other hand, if the voltage of the 24V power supply does not recover to 24V even after a predetermined period of time (for example, 10 ms to 200 ms) has elapsed after turning off the FET 81 of the power supply control circuit 80-2 (S432: No), the FET controller 120 judges that there is no error in the components connected to the 24V power supply control circuit 80-2. Subsequently, the FET controller 120 turns off the FET 81 of the power supply control circuit 80-3 (S440). At this moment, the FET controller 120 may turn off the FET 81 of the power supply control circuit 80-3 after turning on the FET(s) 81 of the power supply control circuit(s) 80-1 and/or 80-2.

After the FET controller 120 has turned off the FET 81 of the power supply control circuit 80-3, the detector 110 checks the voltage of the 24V power supply. If the voltage of the 24V power supply has recovered to 24V (S442: Yes), the FET controller 120 judges that an error has occurred in one of the components connected to the power supply control circuit 80-3, turns all the FETs 81 off, and notifies the user to that effect (S450).

On the other hand, if the voltage of the 24V power supply does not recover to 24V even after a predetermined period of time (for example, 10 ms to 200 ms) has elapsed after turning off the FET 81 of the power supply control circuit 80-3, i.e., after turning off all the FETs 81 of the power supply control circuits 80-1 to 80-3 (S442: No), the FET controller 120 judges that it is impossible to identify the location where the error has occurred, and the low voltage power source 50 cuts off the 24V power supply (S460).

Through the operations described above, the image forming apparatus according to the third embodiment can identify the location where an error has occurred, out of the components connected to the plural FETs, and notify the user to that effect.

Moreover, since the series circuit formed by the resistive element 84 and the capacitative element 85 exists in the image forming apparatus according to the third embodiment, no potential difference occurs between the gate and source of the FET 81 and the electric current does not pass through the FET 81 immediately after the FET 81 has entered the ON state. Accordingly, it is possible to inhibit an inrush current. It is also possible to moderate the switching of the FET 81 and reduce an inrush current when turning on the FIT 81. Moreover, although a sudden increase in the inrush current is inhibited by the series circuit formed by the resistive element 84 and the capacitative element 85, it is possible according to the third embodiment to turn the FET off as appropriate, control the supply of the 24V power to the engine unit, and notify the user of the error location.

The examples and applications described in the above embodiments of the invention can be combined as appropriate in accordance with the intended use, or can be changed or altered for the intended use. The invention is not limited to the descriptions of the aforementioned embodiments. It is obvious from the scope of the claims that such combined, changed, or altered forms may be included in the technical scope of the invention.

What is claimed is:

1. An image forming apparatus for forming an image with an electrophotographic process, comprising:

a power source a first drive unit having a capacitative load and driving each part of the apparatus;

a second drive unit having a capacitative load and driving each part of the apparatus; and a power supply control circuit that is provided on a power supply path between the power source and the second drive unit, that switches whether or not electric power is supplied to the second drive unit;

wherein the power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

2. The image forming apparatus according to claim 1, further comprising a switch that is located on power supply paths extending from the power source toward the first drive unit and the second drive unit respectively, at a position closer to the power source than the power supply control circuit, that switches whether or not the electric power is supplied to the first or second drive unit, by bringing the first or second drive unit into conduction or non-conduction depending on the action of a specified part of the image forming apparatus.

3. The image forming apparatus according to claim 2, wherein the switch brings the first or second drive unit into conduction or non-conduction depending on the opening or closing action of a cover for protecting the outside surface of the image forming apparatus.

4. An image forming apparatus for forming an image with an electrophotographic process, comprising:

a drive unit having a capacitative load and driving each part of the apparatus;

a power source for supplying electric power to the drive unit;

a switch that is located on a power supply path extending from the power source toward the drive unit, that switches whether or not the electric power is supplied to the drive unit, by bringing the drive unit into conduction or non-conduction depending on the action of a specified part of the image forming apparatus; and a power supply control circuit that is provided on the power supply path between the switch and the drive unit, that supplies electric power to the drive unit by becoming conductive in conjunction with the conductive state of the switch;

wherein the power supply control circuit includes: a field-effect transistor with its source connected to the power source side of the power supply path, and its drain connected to the second drive unit side of the power supply path; a first resistive element connected between the field-effect transistor's gate and source; a second resistive element and a capacitative element that are connected in parallel with the first resistive element, and connected with each other in series between the gate and the source.

5. The image forming apparatus according to claim 4, wherein the switch brings the drive unit into conduction or non-conduction depending on the opening or closing action of a cover for protecting the outside surface of the image forming apparatus.

6. An image forming apparatus comprising:

an engine unit for forming an image;

a drive power source for generating a drive voltage to be supplied to the engine unit;

an FET that is provided between the engine unit and the drive power source, that switches whether or not the drive voltage is supplied to the engine unit;

a detector for detecting fluctuation of the drive voltage; and an FET controller for controlling whether the FET is turned on or off depending on fluctuation of the drive voltage detected by the detector, wherein the FET's source is connected to the drive power source, its drain is connected to the engine unit, and its gate is connected to the FET controller, and wherein the FET controller includes:

a first resistive element provided between the source and the gate; and a second resistive element and a capacitative element connected in parallel with the first resistive element and located between the source and the gate.

7. The image forming apparatus according to claim 6, comprising a plurality of FETs, wherein the FET controller turns the FETs off sequentially when the detector detects fluctuation of the drive voltage.

8. The image forming apparatus according to claim 6, comprising a plurality of FETs, wherein the FET controller turns the FETs off when the detector detects fluctuation of the drive voltage, and the FET controller then sequentially turns on the FETs that have been turned off.

9. The image forming apparatus according to claim 6, wherein the FET controller turns the FET off when the drive voltage becomes lower than a specified value; and if the drive voltage becomes higher than the specified value when the FET has been turned off, the FET controller judges that there is an error in the configuration of the engine unit connected to the FET.

10. An image forming apparatus comprising:

an engine unit for forming an image;

a drive power source for generating a drive voltage to be supplied to the engine unit;

an FET that is provided between the engine unit and the drive power source, that switches whether or not the drive voltage is supplied to the engine unit;

an FET controller for controlling whether the FET is turned on or off depending on fluctuation of the drive voltage; and a flag controller for generating a flag when the FET controller turns the FET on;

wherein if the drive voltage fluctuates when the flag controller has generated the flag and the FET controller has turned the FET on, the FET controller turns the FET off in the state where the flag has been generated.

11. The image forming apparatus according to claim 10, wherein if the drive voltage does not fluctuate when the FET controller has turned the FET on, the flag controller clears the flag.

12. The image forming apparatus according to claim 10, wherein if the drive voltage is higher than a specified value for a specified period of time after the FET controller has turned the FET on, the flag controller clears the flag.

13. The image forming apparatus according to claim 10, wherein if the drive voltage becomes lower than a specified value when the FET controller has turned the FET on, the FET controller turns the FET off in the state where the flag has been generated.

14. The image forming apparatus according to claim 13, further comprising a notifying unit for giving a specified notice to a user if the flag has been generated when the FET controller turns the FET on.

15. The image forming apparatus according to claim 10, comprising a plurality of FETs, wherein the FET controller turns the FETs off sequentially when the FET controller detects fluctuation of the drive voltage.

16. The image forming apparatus according to claim 10, comprising a plurality of FETs, wherein the FET controller turns the FETs off when it detects fluctuation of the drive voltage, and the FET controller then sequentially turns on the FETs that have been turned off.

17. The image forming apparatus according to claim 10, wherein the FET controller turns the FET off when the drive voltage becomes lower than a specified value; and if the drive voltage becomes higher than the specified value when the FET has been turned off, the FET controller judges that there is an error in the configuration of the engine unit connected to the FET.

18. The image forming apparatus according to claim 10, wherein the FET's source is connected to the drive power source, its drain is connected to the engine unit, and its gate is connected to the FET controller, and wherein the FET controller includes:

a first resistive element provided between the source and the gate; and a second resistive element and a capacitative element connected in parallel with the first resistive element and located between the source and the gate.

* * * * *